US010066864B2

(12) United States Patent
Gonzalez

(10) Patent No.: US 10,066,864 B2
(45) Date of Patent: Sep. 4, 2018

(54) NOVELTY COOLING DEVICE

(71) Applicant: Walter Gonzalez, Coral Gables, FL (US)

(72) Inventor: Walter Gonzalez, Coral Gables, FL (US)

( * ) Notice: Subject to any disclaimer, the term of this patent is extended or adjusted under 35 U.S.C. 154(b) by 0 days.

(21) Appl. No.: 14/801,397

(22) Filed: Jul. 16, 2015

(65) Prior Publication Data

US 2017/0013981 A1 Jan. 19, 2017

(51) Int. Cl.
*F25D 3/08* (2006.01)
*A47G 19/22* (2006.01)

(52) U.S. Cl.
CPC ..... *F25D 3/08* (2013.01); *A47G 19/2288* (2013.01); *F25D 2303/0846* (2013.01); *F25D 2331/803* (2013.01)

(58) Field of Classification Search
CPC ..... A47G 19/2227
USPC ..... 220/737, 739, 694, 703; 215/386–399
See application file for complete search history.

(56) References Cited

U.S. PATENT DOCUMENTS 2,154,772 A * 4/1939 Rathemacher ..... A47G 11/001 150/901
5,806,904 A * 9/1998 Smith ..... B65D 23/104 215/396
2009/0264264 A1* 10/2009 Reen ..... A63B 69/004 482/86
2010/0102096 A1* 4/2010 Willows ..... A45F 5/00 224/148.1
2013/0126540 A1* 5/2013 Vesterby ..... B65D 37/00 220/737

* cited by examiner

*Primary Examiner* — Kareen Thomas
(74) *Attorney, Agent, or Firm* — Ruben Alcoba, Esq.

(57) ABSTRACT

A device that is placed around the neck of a beverage bottle. The device hangs from the neck of the bottle towards the body of the bottle and thereby cools the contents that are held within the bottle. The device is comprised of three sections, a top section that is elastic in nature and that defines an aperture that surrounds the circumference of a bottle. A middle section that extends from the top section for a distance of at least 1 inch, the middle section may or may not be elastic. And lastly, a bottom section that is composed of two ball sacs that are connected at a mid-juncture so that they are flexible enough to hang from the neck of the bottle while draping over the outside of the bottle so that the contents within the bottle are chilled. The bottom section may be made of materials that absorb moisture and that have insulating qualities.

2 Claims, 3 Drawing Sheets

NOVELTY COOLING DEVICE

BACKGROUND

The present invention is directed towards a novelty cooling device that is used during bachelorette parties to celebrate a bride's last hurrah.

A bachelorette party is a party that is given for a woman who is about to get married, typically one attended by women only.

The parties take a lot of preparation and normally incur waiting times for the guest and the bride to present themselves. Often, drinks and novelty items are placed at the location of the party prior to the bride arriving to the party.

When drinks are placed in advance of the bride or guests reaching the party, often the drinks warm to temperatures that are unsavory to drink.

For the foregoing reason the inventor conceived of the novelty item of the present invention. The item is a beverage novelty cooling device that is placed around the neck of a beverage bottle. The device hangs from the neck of the bottle towards the body of the bottle and thereby cools the contents that are held within the bottle. The present invention allows the bride and her guests to enjoy a chilled drink when they reach the bachelorette party while simultaneously providing them a humorous moment.

SUMMARY

The present invention is a device that is placed around the neck of a beverage bottle. The device hangs from the neck of the bottle towards the body of the bottle and thereby cools the contents that are held within the bottle. The device is comprised of three sections, a top section that is elastic in nature and that defines an aperture that surrounds the circumference of a bottle. A middle section that extends from the top section for a distance of at least 1 inch, the middle section may or may not be elastic. And lastly, a bottom section that is composed of two ball sacs that are connected at a mid-juncture so that they are flexible enough to hang from the neck of the bottle while draping over the outside of the bottle so that the contents within the bottle are chilled. The bottom section may be made of materials that absorb moisture and that have insulating qualities.

An object of the present invention is to provide a novelty item that will be used at bachelorette parties.

Another object of the present invention is to provide a product or device that will chill the contents within a bottle.

A further object of the present invention is to provide a device that absorbs the sweat or moisture that develops around the outside of a bottle as the contents within the bottle warm when a cold liquid is disposed within the bottle.

Still a further object of the present invention is to provide a device that will catch any condensation formed on a bottle from dripping on a person when the person drinks from the bottle.

DRAWINGS

These and other features, aspects, and advantages of the present invention will become better understood with regard to the following description, appended claims, and drawings where:

DESCRIPTION

Figure 1:
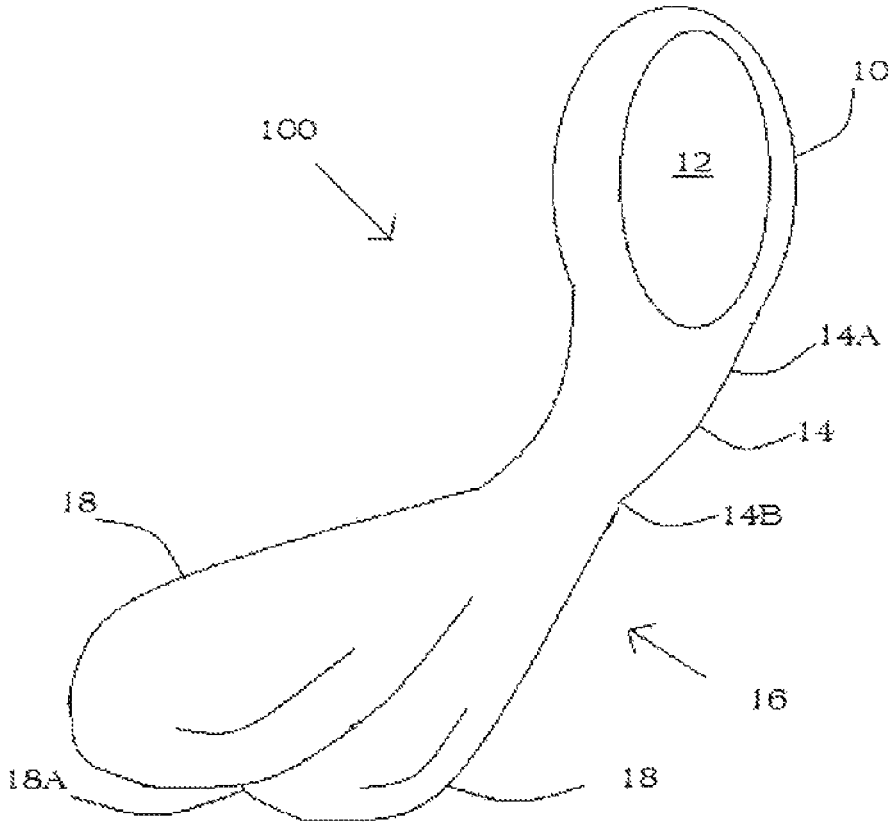
FIG. 1 shows a perspective view of the present invention.
Figure 2:
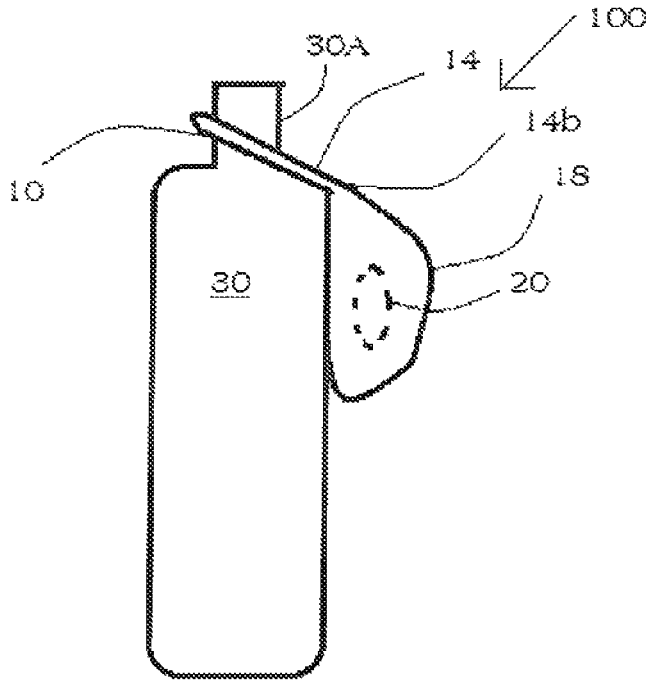
FIG. 2 shows a side view of the present invention wherein the device is draped over a bottle.
Figure 3:
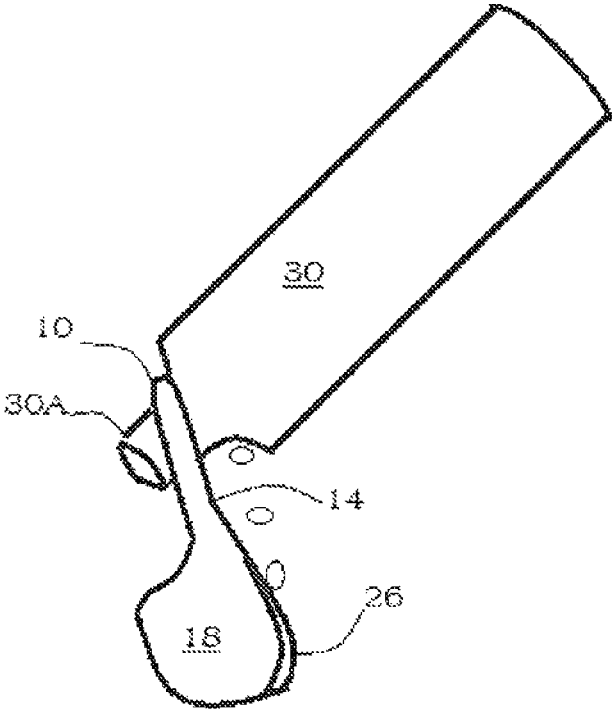
FIG. 3 shows a side view of the present invention wherein the figure shows how the device catches the sweat of the bottle.

FIGS. 1-3 show a novelty device 100 that is used a bachelorette parties to chill drinks that are served in a bottle. The novelty device comprises of a top section 10 that defines an aperture 12 that is placed around a neck of a bottle. The top section 10 can also be identified as a ring. The top section 10 is made of a material that is an elastic such as rubber, plastic or any other stretchy material. A middle section 14 that has a top 14A and a bottom side 14B. The top side 14A of the middle section 14 attaches to the top section 10. The middle section 14 has a length that is at least one inch. The middle section 14 can also be identified as an elongated middle section 14. The middle section 14 may be made of an elastic material and may be lined with a material that absorbs condensation. A bottom section 16, the bottom section 16 is composed of a pair of sacs 18 that are attached to the bottom side 14B of the middle section 14. The sacs 18 are fixedly attached to each other at a mid-juncture 18A so that when they are placed around a bottle they can drape around the body of the bottle. The bottom section 16, in a preferred embodiment, is made of an insulating material. The bottom section 16 can be made of rubber and may contain a gel or material that retains heat. As seen in FIG. 3, the bottom section 16, in another embodiment, may be lined with a material 26 that absorbs condensation 80.

An advantage of the present invention is that it provides a novelty item that is used at bachelorette parties.

Another advantage of the present invention is that it provides a product or device that chills contents within a bottle.

A further advantage of the present invention is that it provides a device that absorbs sweat or moisture that develops around the outside of a bottle as the contents within the bottle warm when a cold liquid is disposed within the bottle.

Still a further advantage of the present invention is that it provides a device that catches any condensation formed on a bottle from dripping on a person when the person drinks from the bottle.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A novelty gag device that is used at bachelorette parties to chill drinks that are served in a bottle, the device comprises:

a ring sized to fit snuggly around the neck of the bottle; and an elongated middle section having an upper and lower side, wherein the ring is at the upper side of the elongated middle section, and wherein the bottom side of the elongated middle section is adjoined to a pair of insulated ball sacs that are fixedly attached to each other, the ball sacs are designed to go around the neck of the bottle and when the contents of the bottle are drunk the ball sacs are designed to fall on the neck of a drinker of the bottle.

2. The novelty device of claim 1, wherein the insulated ball sacs are fixedly attached to each other at a mid-juncture.

* * * * *